United States Patent [19]

Rossi

[11] Patent Number: 4,745,385

[45] Date of Patent: May 17, 1988

[54] SWITCHING RELAYS

[75] Inventor: Guglielmo Rossi, Linkenheim-Hochstätten, Fed. Rep. of Germany

[73] Assignee: Ranco Incorporated, Dublin, Ohio

[21] Appl. No.: 85,325

[22] Filed: Aug. 11, 1987

Related U.S. Application Data

[63] Continuation of Ser. No. 804,269, Dec. 3, 1985, abandoned.

[30] Foreign Application Priority Data

Dec. 4, 1984 [DE] Fed. Rep. of Germany ..... 3444223

[51] Int. Cl.[4] ..... H01H 9/00

[52] U.S. Cl. ..... 335/208; 335/146; 335/148; 361/162; 361/208; 361/211

[58] Field of Search ..... 335/146, 148, 208; 361/162, 208, 211

[56] References Cited

U.S. PATENT DOCUMENTS

| | | | |
|---|---|---|---|
| 3,256,410 | 6/1966 | Bastian | 200/122 |
| 3,566,225 | 2/1971 | Poulsen | 335/146 X |
| 3,760,310 | 9/1973 | Carson | 335/146 |
| 3,858,131 | 12/1974 | Larsson | 335/131 X |
| 4,123,746 | 10/1978 | DuRocher | 361/211 X |
| 4,383,231 | 5/1983 | Yamanaka et al. | 335/208 X |
| 4,434,411 | 2/1984 | Anderson, III et al. | 335/146 X |

FOREIGN PATENT DOCUMENTS

| | | | |
|---|---|---|---|
| 1160925 | 1/1964 | Fed. Rep. of Germany . | |
| 1994003 | 9/1968 | Fed. Rep. of Germany . | |
| 1614972 | 5/1970 | Fed. Rep. of Germany | 335/193 |
| 1959345 | 6/1970 | Fed. Rep. of Germany . | |
| WO82/00219 | 1/1982 | PCT Int'l Appl. . | |

OTHER PUBLICATIONS

International Search Report for Appl. PCT/SE81/00188, (see PCT/WO82/00219).

*Primary Examiner*—Arthur T. Grimley
*Assistant Examiner*—Jane K. Lau
*Attorney, Agent, or Firm*—Watts, Hoffmann, Fisher & Heinke

[57] ABSTRACT

A temperature compensated switching relay with thermally effected switching delay should be of simple and compact construction and reliable in switching with precisely adjustable switching delay. For this purpose, the switching relay comprises a switching member (1) movable between two end positions and bearing a permanent magnet (2), with an inherent snapping action to actuate at least one switching contact (6), on opposite sides of the permanent magnet (2) in its direction of movement a first and a second paramagnetic member (3, 4) is provided, on the first paramagnetic member (3) a PTC resistor (5) feedable by a source of current is mounted, and in the end position of the switching member (1) at the second paramagnetic member (4) the distance (A) of the permanent magnet (2) from the first paramagnetic member (3) is less than its distance (B) from the second paramagnetic member (4). The ratios of the distances of the permanent magnet (2) from the paramagnetic members (3, 4) can expediently be adjusted.

19 Claims, 5 Drawing Sheets

SWITCHING RELAYS

Figure 1:
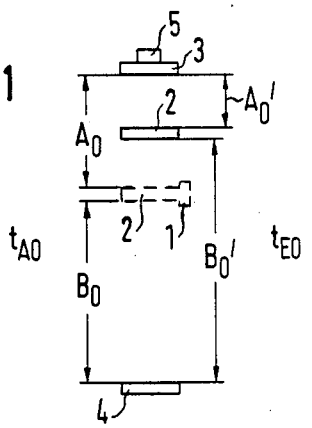

This application is a continuation of application Ser. No. 804,269, filed Dec. 3, 1985, now abandoned.

The invention relates to a temperature compensated switching circuit with thermally effected switching delay.

Known relays of this kind are constructed with a movable bimetal member with heating coil surrounding this bimetal member or a heating resistor mounted on the bimetal member. The movement of the bimetal member takes place continuously unless additional measures are provided, and not, as desirable for an electrical switching operation, as snap action. The known switching relays are of complicated construction and relatively difficult to adjust.

The invention is based on the object of providing a temperature compensated switching relay with thermally effected switching delay which is of simple and compact construction and is reliable in the switching action including the stability of the switching delay, and already inherently includes a snap action in the switching operation.

According to the invention, this object is solved in that the switching relay comprises a switching member movable between two end positions and bearing a permanent magnet, said switching member actuating at least one switching contact, that on opposite sides of the permanent magnet in the direction of movement thereof a first and a second paramagnetic member is provided, that on said first paramagnetic member a positive temperature coefficient (PTC) resistor feedable by a source of current is mounted, and that in the end position of the switching member at said second paramagnetic member the distance of the permanent magnet from said first paramagnetic member is less than its distance from said paramagnetic member.

When the PTC resistor is not energized, the two paramagnetic members have substantially the same temperature and thus the same magnetic conductivity, so that the permanent magnet draws the switching member into its end position at the first paramagnetic member. If the PTC resistor is now energized, the first paramagnetic member is heated with a delay time determined by the transfer of heat from the PTC resistor to this member until it looses its magnet conductivity. Hereupon, the attraction between the second paramagnetic member and the permanent magnet predominates and the switching member snaps into its end position at the second paramagnetic member. If the PTC resistor is now switched off, the temperature of the first paramagnetic member decreases with a delay determined by the dissipation of heat from this member until the first paramagnetic member recovers its magnetic conductivity and the switching member snaps back into the end position at the first paramagnetic member.

Apart from being dependent on the transfer of heat to and from the first paramagnetic member the switching delay time depends on the ratio of the distances of the permanent magnet from the paramagnetic members in both end positions of the switching member.

In the following the time during which the switching member is in its end position at the first paramagnetic member is defined as ON time and the time during which the switching member is in the end position at the second paramagnetic member is defined as OFF time.

Both times are dependent on the ratio of the distances of the permanent magnet from the paramagnetic members.

According to a further development of the invention, the ratio of the distances of the permanent magnets from the paramagnetic members is adjustable.

The adjustment of the ratio of the distances of the permanent magnets from the paramagnetic members can take place in different manners.

If the distance of the two paramagnetic members is kept constant and the end position of the switching member at the second paramagnetic member varies, the ON time remains the same and the OFF time changes. If the distance between the two paramagnetic members is kept constant and the end position of the switching member at the first paramagnetic member varies, the ON time varies and the OFF time remains constant. In both cases the sum of ON time and OFF time (period) varies.

Upon unaltered end positions of the switching member and variation of the position of the first or second paramagnetic member the ON time and the OFF time vary in a contrary sense, the sum of which remains the same (constant period).

Upon alteration of the position of the first or second paramagnetic member with simultaneous alteration of the end position of the switching member at the corresponding paramagnetic member in such a manner that the distance to the corresponding paramagnetic member in the end position at this paramagnetic member remains unchanged, ON time and OFF time alter in the same sense and thus the sum of the two times (period).

In at least one disclosed embodiment of the invention, premise for the consideration with respect to the periods in all cases is that the PTC resistor is energized during the ON time and de-energized during the OFF time.

Advantageously at least one adjustable stop means is provided for the switching member at its one end position and/or at its other end position.

In a further development of the invention to an embodiment of the switching relay as energy regulator, the at least one switching contact in the end position of the switching member at the first paramagnetic member closes the feed circuit of the PTC resistor and the stop means for the switching member in the end position at the second paramagnetic member is constructed as stop screw with rotating knob. With this construction the switching relay becomes an energy regulator for the pulsewise energizing and de-energizing of a load, for example a hot plate of a cooker. The switch for switching on and off the hot plate can also be actuated by the stop screw with rotating knob. The regulation takes place by varying the OFF time with constant ON time.

According to a further development of the invention to a further embodiment of an energy regulator, the at least one switching contact in the end position of the switching member at the first paramagnetic member closes the feed circuit of the PTC resistor and an adjustment screw acting on the second paramagnetic member having a rotating knob is provided to adjust the distance between the first and second paramagnetic members. The regulation takes place here by variation in a contrary sense of the ON time and OFF time with substantially constant sum of both times, i.e. substantially constant periods of the supply of energy.

A further embodiment of the switching relay according to the invention as door locking relay results from a locking bolt being provided which is shifted by the switching member upon movement into the end position at the second paramagnetic member in such a manner that a door is locked. When switching on an external switch, the PTC resistor is energized on here and upon its movement into the end position at the second paramagnetic member the switching member shifts the locking bolt into its locking position. The door remain locked as long as the external switch is closed. If the external switch is opened, the release of the locking takes place delayed by the OFF time. Such a door locking relay is suitable for example to lock the door of a washing machine also for a delay time beyond the switching off of the drum motor.

According to a further development of the door locking relay according to the invention, the at least one switching contact in the end position of the switching member at the second paramagnetic member closes a load circuit, for example the circuit of th drum motor in a washing machine. With this development of the door locking relay according to the invention, it is ensured that the load circuit is only energized when the door is locked.

A calibration screw acting on the second paramagnetic member is advantageously provided to adjust the distance between the first and the second paramagnetic members. With this calibration screw the ON time and the OFF time can be varied in a contrary sense.

A further development of the invention consists in that the at least one switching contact in the end position of the switching member at the first paramagnetic member closes the feed circuit of the PTC resistor and that a click-stop device with a release button is provided for the releasable holding of the switching member in the end position at the second paramagnetic member. This provides a switching relay with manual switching on operation and time delayed automatic switching off operation.

The delay relay constructed in such a manner can be further developed such that an adjustment screw acting on the first paramagnetic member and/or an adjustment screw acting on the second paramagnetic member is provided to adjust the distance between the first and second paramagnetic members. The ON time can be varied by means of the adjustment screws, on the one hand with variation of the OFF time in the same sense and on the other hand with variation of the OFF time in contrary sense.

Alternatively, an adjustable stop means can be provided for the switching member in the end position at the first paramagnetic member. In this way the ON time can be adjusted with unaltered OFF time.

According to a further development of the invention, the at least one switching contact in the end position of the switching member at the first paramagnetic member closes the feed circuit of the PTC resistor, and electrically in series connection to this feed circuit an electric holding magnet is provided acting on the switching member in the end position at the first paramagnetic member. This construction of the switching relay leads to a compressor re-start relay with delayed energizing of the compressor after preceding operation of the compressor. The compressor re-start relay only energizes the compressor if the ON time since the preceding de-energizing of the compressor has expired. It is thus ensured that a sufficient time is available for the reduction of the head pressure of the compressor from the preceding energizing cycle.

Advantageously a further switching contact is provided which in the end position of the switching member at the second paramagnetic member switches on a means for the more rapid reduction of the head pressure of a compressor. It can thus be achieved that during the OFF time for example by bridging a restriction position, the head pressure of the compressor is reduced more rapidly.

A further development of the invention for providing a compressor re-start relay consists in that the at least one switching contact in the end position of the switching member at the first paramagnetic member closes the feed circuit of the PTC resistor, that a spring-loaded lever forms both a stop means for the switching member on the side of the second paramagnetic member and a further switching member for a power switching contact closed in the end position of the first switching member at the first paramagnetic member, and that electrically in series connection to the feed circuit of the PTC resistor an electric holding magnet is provided acting on the lever in its end position at the first paramagnetic member. The load, for example the compressor, is energized here not via the switching contact of the switch initiating the switch on operation, but via the separate power switching contact.

Here also a further switching contact can again be provided which in the end position of the switching member at the second paramagnetic member switches on a means for the more rapid reduction of the head pressure of a compressor.

If both compressor start relays, the adjustment of the OFF time is essential. Accordingly an adjustment screw engaging with the switching member or lever is advantageously provided for adjusting the end position of the switching member at the second paramagnetic member. Upon adjustment of this adjustment screw, the ON time remains unchanged whereas the OFF time varies.

Finally on the compressor re-start relay expediently a spring-loaded push button acting on the switching member is provided for the manual movement of the switching member into its end position at the first paramagnetic member. This push button permits a manual energizing of the compressor for testing purposes even with a directly preceding operation of the compressor.

The invention is described in more detail in the following with respect to embodiments of the invention and with reference to the drawings. The drawings show FIG. 1 a schematic representation of the arrangement of the essential members of a switching relay according to the invention, FIGS. 2(*a–c*) and 3(*a–c*) schematic representations of different positions of the members shown in FIG. 1 with respect to each other upon different changes in adjustment of the distances of the members with respect to each other, FIG. 4 a representation of a first embodiment of the switching relay according to the invention as energy regulator, FIG. 5 a schematic representation of a second embodiment of the switching relay according to the invention as energy regulator, FIG. 6 a schematic representation of a third embodiment of the switching relay according to the invention as door locking relay, FIG. 7 a schematic representation of a fourth embodiment of the switching relay according to the invention as switch on relay with delayed switching off, FIG. 8 a schematic representation of a fifth embodiment of the switching relay according to the invention as switch on relay with delayed switching off, FIG. 9 a schematic representation of a sixth embodiment of the switching relay according to the invention as compressor re-start relay, and FIG. 10 a schematic representation of a seventh embodiment of the switching relay according to the invention as compressor re-start relay.

Figure 2:
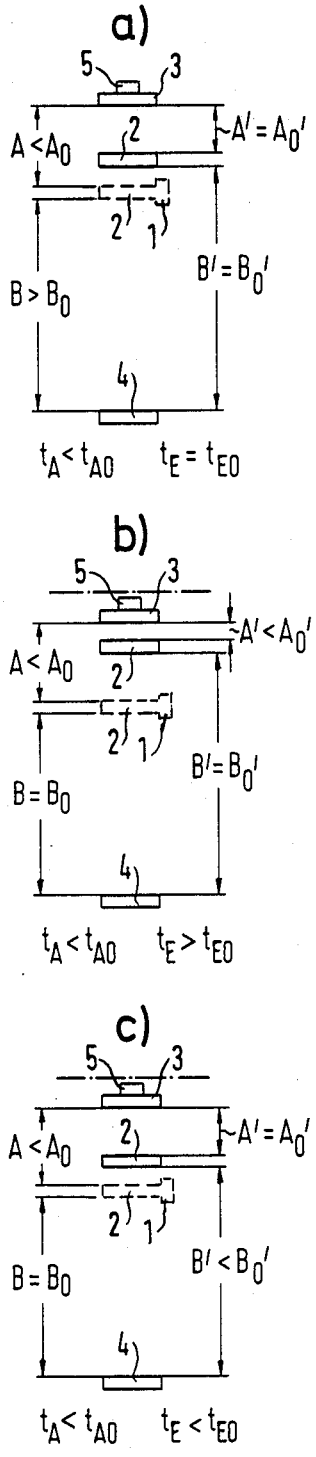
Figure 3:
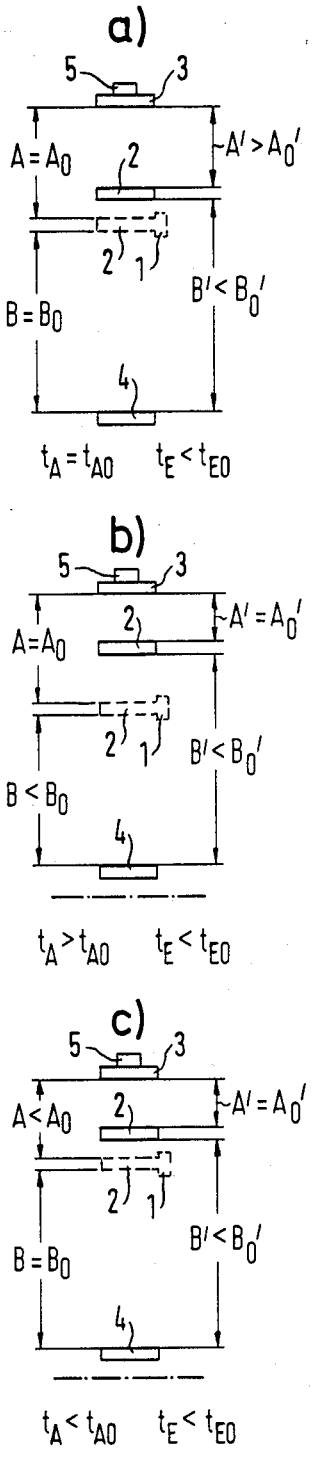

In FIGS. 1 to 3, the essential members of the switching relay according to the invention are represented schematically in their different positions with respect to each other. A switching member 1 bears a permanent magnet 2. The switching member 1 with permanent magnet 2 is arranged between a first paramagnetic member 3 and a second paramagnetic member 4 and movable between the two paramagnetic members 3, 4. The first paramagnetic member 3 bears a PTC resistor 5 feedable by a source of current. In FIGS. 1 to 3 the switching member 1 with permanent magnet 2 in its end position at the second paramagnetic member 4 is shown in continuous lines and in its end position at the first paramagnetic member in dotted lines.

As long as the PTC resistor 5 is not energized, i.e. receives no current, both the first paramagnetic member 3 and the second paramagnetic member 4 are magnetically conducting and the switching member 1 with the permanent magnet 2 is in its end position at the first paramagnetic member 3. If now the PTC resistor 5 is energized, the first paramagnetic member 3 is heated by same so long until it looses its magnetic conductivity, the effect of the second paramagnetic member 4 predominates and the permanent magnet 2 with the switching member 1 is snapped into its end position at the second paramagnetic member 4. If upon this movement the PTC resistor 5 is de-energized, the first paramagnetic member 3 will cool down, recover its magnetic conductivity and have the effect that the permanent magnet 2 and thus the switching member 1 move back into the end position at the first paramagnetic member 3.

In FIG. 1 the individual members are shown in their basic positions The time during which the switching member 1 with the permanent magnet 2 is in the end position at the first paramagnetic member 3 is defined as ON time $t_{E0}$ ($t_E$ in FIGS. 2 and 3), the time during which the switching member 1 with the permanent magnet 2 is in the end position at the second paramagnetic member 4 is defined as OFF time $t_{A0}$ ($t_A$ in FIGS. 2 and 3). In the end position of the switching member 1 at the second paramagnetic member 4, the distance of the permanent magnet 2 to the first paramagnetic member 3 amounts to $A_0$ (A in FIGS. 2 and 3) and its distance to the second paramagnetic member 4 amounts to $B_0$ (B in FIGS. 2 and 3). In the end position of the switching member 1 at the first paramagnetic member 3, the distance of the permanent magnet 2 to the first paramagnetic member 3 amounts to $A_0'$ (A' in FIGS. 2 and 3) and its distance to the second paramagnetic member 4 amounts to $B_0'$ (B' in FIGS. 2 and 3). The distance A or $A_0$ must always be less than the distance B or $B_0$ for the desired actions of force for the function of the switching relay to occur. A possible force bias of the switching member 1 is to be considered equivalent to a determination or variation of the distances, respectively.

For the adjustment of the ON time $t_E$ and the OFF time $t_A$, the ratio of the distances of the permanent magnet 2 from the paramagnetic members 3, 4 can be expediently adjusted. This adjustment can take place by varying the positions of the two end positions of the switching member 1 with permanent magnet 2 and/or adjustment of the paramagnetic members 3, 4. In FIGS. 2 and 3 different possibilities of the adjustment are shown and are described in the following in more detail regarding their effects in connection with adjustments to the inside.

According to FIG. 2*a*, with unchanged position of the paramagnetic members 3, 4, an adjustment of the end position of the switching member 1 with permanent magnet 2 at the second paramagnetic member 4 can take place. As compared to the values $A_0$, $B_0$, $A_0'$, $B_0'$, $t_{A0}$ and $t_{E0}$, the distance A is reduced, the distance B increased, whereas the distances A' and B' remain the same. The ON time $t_E$ remains the same, the OFF time $t_A$ decreases; the switching period decreases.

According to FIG. 3*a*, with unchanged position of the paramagnetic members 3, 4, the end position of the switching member 1 with permanent magnet 2 adjusted at the first paramagnetic member 3 can be adjusted. The distances A and B remain the same, the distance A' increases and the distance B' decreases. The ON time $t_E$ decreases, the OFF time $t_A$ remains the same; the switching period decreases.

According to FIG. 2*b*, merely the first paramagnetic member 3 is adjusted. The distance A decreases, the distance B remains the same, whereas the distance A' decreases and the distance B' remains the same. The ON time $t_E$ increases, the OFF time $t_A$ decreases; the switching period remains essentially the same.

According to FIG. 3*b*, only the second paramagnetic member 4 is adjusted. The distance A remains the same, the distance B decreases, whereas the distance A' remains the same and the distance B' decreases. The ON time $t_E$ decreases and the OFF time $t_A$ increases; the switching period remains essentially the same.

According to FIG. 2*c* both the first paramagnetic member 3 and the end position of the switching member 1 with permanent magnet 2 at the first paramagnetic member 3 are adjusted in the same sense. The distance A is reduced and the distance B remains the same, whereas the distance A' remains the same and the distance B' is reduced. The ON time $t_E$ and the OFF time $t_A$ are both reduced.

According to FIG. 3*c* the second paramagnetic member 4 and the end position of the switching member 1 with permanent magnet 2 at the second paramagnetic member 4 are adjusted in the same sense. The effect ist the same as described with respect to FIG. 2*c*.

In FIGS. 4 to 10 different embodiments of a switching relay according to the invention are shown. In all these embodiments the switching member 1 is constructed as pivot lever. Furthermore in all the embodiments at least one switching contact 6 is provided which is actuated by the switching member 1.

Figure 4:
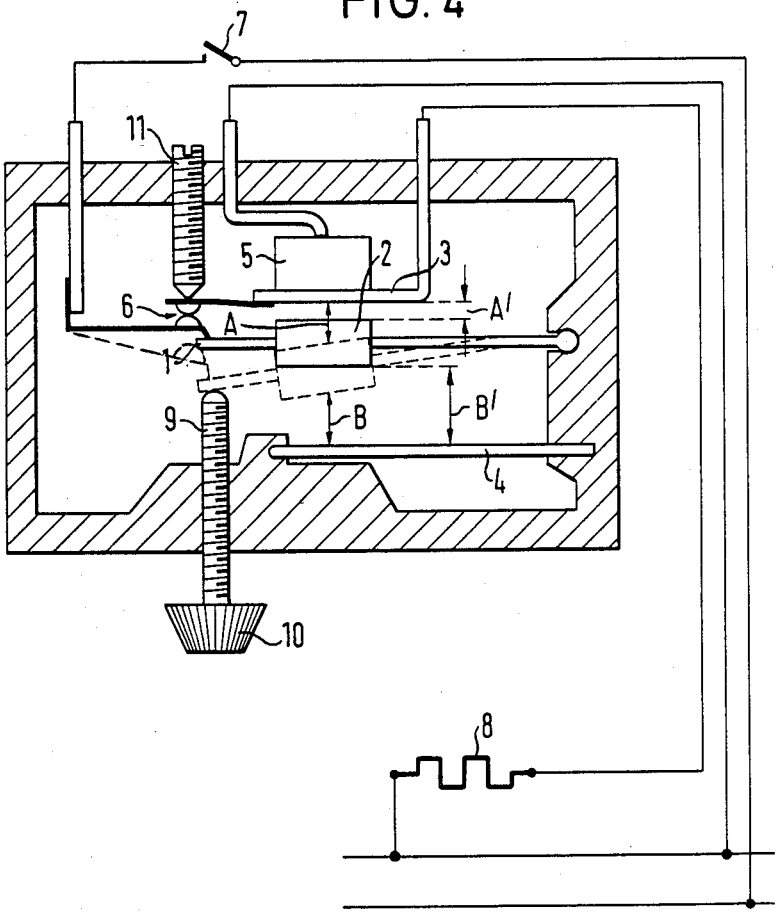

FIG. 4 shows an embodiment of the switching relay as energy regulator. The switching contact 6 in the end position of the switching member 1 at the first paramagnetic member 3 closes the feed circuit of the PTC resistor 5. Via a switch 7, both the PTC resistor 5 and parallel hereto a load 8, for example the hot plate of a cooker, are connected to a source of electric energy, while the switching member 1 is in its end position at the first paramagnetic member 3. As soon as now by means of the PTC resistor 5 the first paramagnetic member 3 has been heated to the extent that it looses its magnetic conductivity, the switching member 1 snaps into the end position at the second paramagnetic member 4. In this way the switching contact 6 is opened and the supply of energy is switched off both to the PTC resistor 5 and to the load 8. When the first paramagnetic member 3 has cooled off again and recovered its magnetic conductability, the switching member 1 snaps back into the end position at the first paramagnetic member 3 and the cycle starts again.

As stop means for the switching member 1 in the end position at the second paramagnetic member 4, a stop screw 9 with rotating knob 10 is provided. In addition an adjustment screw 11 can be provided as indirect stop means for the switching member 1 in the end position at the first paramagnetic member 3. With the stop screw 9 with rotating knob 10, an adjustment of the switching member 1 can be performed as described in connection with FIG. 2*a*, whereas by means of the adjustment screw 11, an adjustment of the switching member can be performed as described in connection with FIG. 3*a*. In the first case, the ON time $t_E$ remains unchanged and the OFF time $t_A$ varies, whereas in the second case the ON time $t_E$ is varied and the OFF time $t_A$ remains unchanged. In both cases the ratio of the ON time $t_E$ to the OFF time $t_A$ varies and thus the duration of switching on and switching off of the load 8 with respect to each other. It is a case of an automatic pulse feed of the load 8. The switch 7 can be integrated with the stop screw 9 together with the rotating knob 10 in one structural component.

Figure 5:
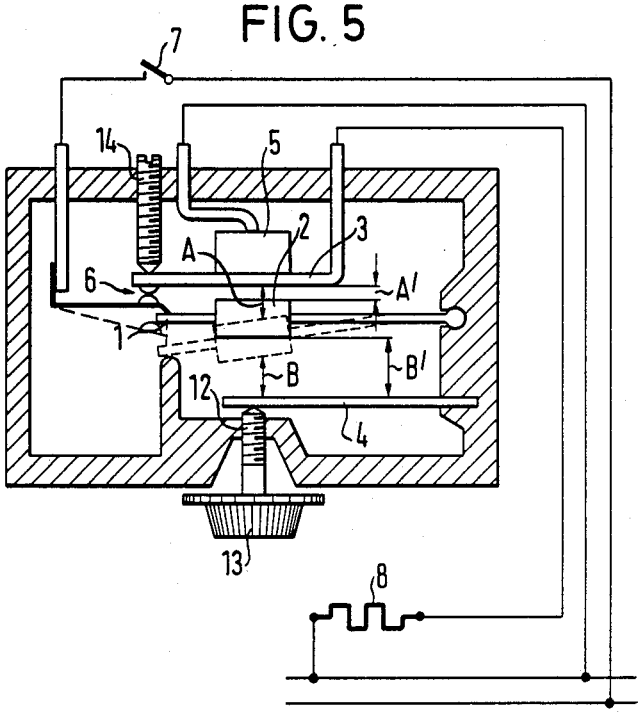

FIG. 5 shows a further embodiment of the switching relay as energy regulator. Here instead of the stop screw 9 with rotating knob 10 an adjustment screw 12 with rotating knob 13 is provided, which acts on the second paramagnetic member 4 to adjust the distance between the first paramagnetic member 3 and the second paramagnetic member 4. Furthermore an adjustment screw 14 acting on the first paramagnetic member 3 can be provided to adjust the distance between the first paramagnetic member 3 and the second paramagnetic member 4. A rotation of the adjustment screw 12 leads to the adjustment of the ON time $t_E$ and the OFF time $t_A$ with substantially constant switching period as described in connection with FIG. 3*b*, whereas an adjustment of the adjustment screw 14 leads to a corresponding change of the times as described in connection with the FIG. 2*b*.

Figure 6:
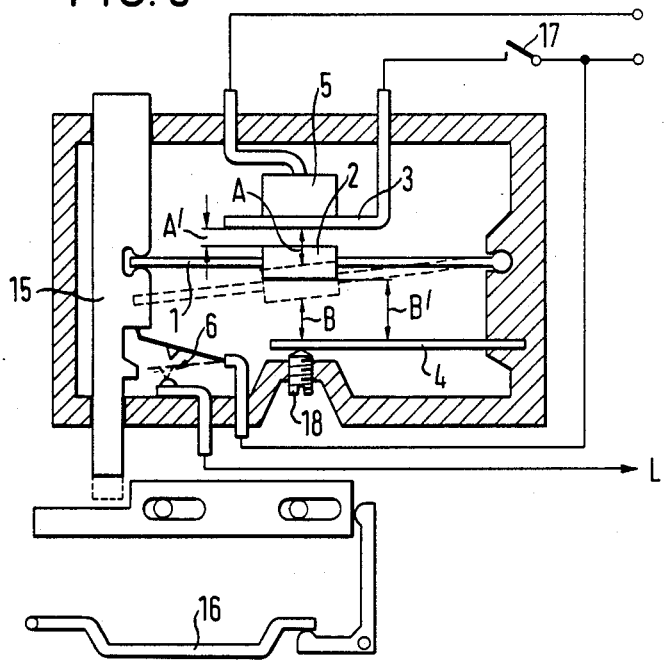

FIG. 6 shows a switching relay which is constructed as door locking relay for example the door of a drum washing machine. A locking bolt 15 is provided here, which is shifted by the switching member 1 upon movement into the end position at the second paramagnetic member in such a manner that a door 16 is locked. When switching on an external switch 17, the PTC resistor 5 is energized and the switching member 1 upon its movement into the end position at the second paramagnetic member 4 shifts the locking bolt 15 into its locking position. The door 16 remains locked as long as the external switch 17 is closed. When the external switch 17 is opened, the release of the locking takes place delayed by the OFF time $t_A$. Such a door locking relay is suitable for example for locking the door of a washing machine also for a delay time beyond the de-energizing of the drum.

The at least one switching contact 6 is preferably arranged in the door locking relay in such a manner that in the end position of the switching member 1 at the second paramagnetic member 4 it closes for example the circuit of the drum motor in a washing machine. It is thus ensured that the load circuit L is only switched on if the door 16 is also locked. In the door locking relay an adjustment screw 18 acting on the second paramagnetic member 4 is further provided to adjust the distance between the first paramagnetic member 3 and the second paramagnetic member 4. With this adjustment screw 18 the ON time $t_E$ and the OFF time $t_A$ can be varied in a contrary sense, as has been described in connection with FIG. 3*b*. The adjustment of the OFF time $t_A$ is essential here.

Figure 7:
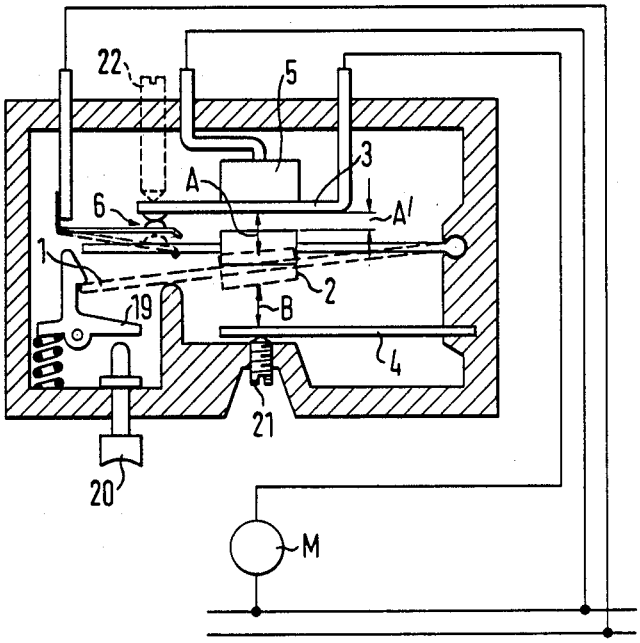

FIG. 7 shows a further embodiment of the switching relays as delay relay with manual switch on operation and time delayed automatic switch off operation. The switching contact 6 in the end position of the switching member 1 at the first paramagnetic member 3 closes the feed circuit of the PTC resistor 5 here, and a click-stop device 19 with release button 20 is provided for the releasable holding of the switching member 1 in the end position at the second paramagnetic member 4. By actuating the release button 20, the click-stop device 19 is released and a load M, for example a motor is connected to a source of current in series with the PTC resistor 5. Upon expiration of the ON time $t_E$ the delay relay opens the circuit via the switching contact 6 and both the PTC resistor 5 and also the load M are switched off. The click-stop device 19 holds the switching member 1 in the end position at the second paramagnetic member 4 until it is released by the push button 20 to carry out the next cycle.

Furthermore an adjustment screw 21 acting on the second paramagnetic member 4 or alternatively an adjustment screw 22 acting on the first paramagnetic member 3 is provided for the adjustment of the distance between the first paramagnetic member 3 and the second paramagnetic member 4. With both adujustment screws the ON time $t_E$ can be adjusted, namely with the adjustment screw 21 as described in connection with FIG. 3*b* and with the adjustment screw 22 as described in connection with FIG. 2*c*.

Figure 8:
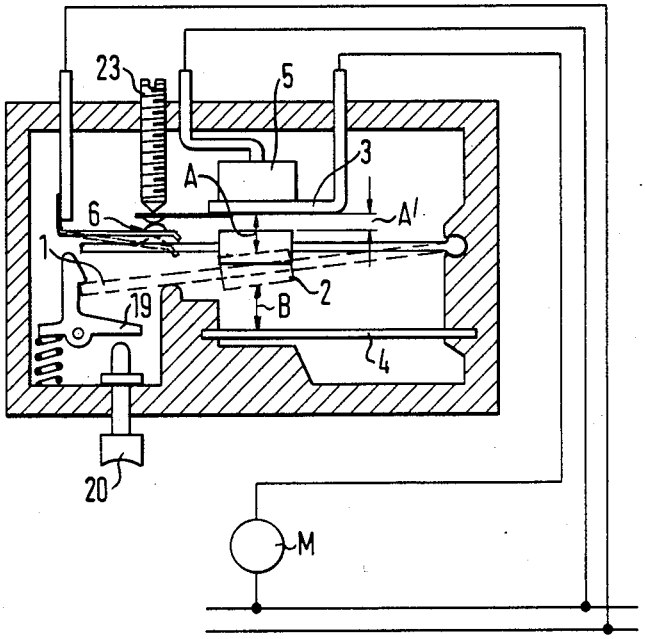

FIG. 8 shows a further embodiment of a delay relay wherein instead of the adjustment screws 21 and 22 an adjustable stop means to the switching member 1 is provided in the end position at the first paramagnetic member 3 in the form of an indirectly acting stop screw 23. The ON time $t_E$ can thus be adjusted upon unaltered OFF time $t_A$, as is described in connection with FIG. 3*a*.

Figure 9:
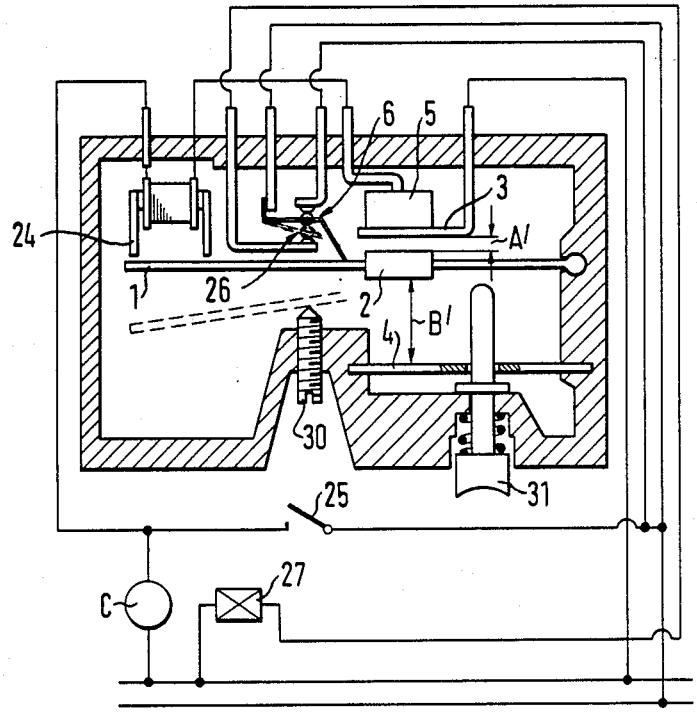

An especially important embodiment of the switching relay as compressor re-start relay is shown in FIG. 9. In this compressor re-start relay the contact 6 in the end position of the switching member 1 at the first paramagnetic member 3 closes the feed circuit of the PTC resistor 5, and electrically in series connection to this feed circuit an electric holding magnet 24 is provided acting on the switching member 1 in the end position at the first paramagnetic member 3. When closing an external switch 25, for example the switch in a thermostat, the electric holding magnet 24 and the PTC resistor 5 are fed by a source of energy with the first paramagnetic member 3 being cold. Simultaneously a compressor C is energized. This condition is maintained as a result of the effect of the electric holding magnet 24 until the switch 25 is re-opened. A new closing of the switch 25 with the first paramagnetic member 3 still being warm only leads to another energizing of the compressor C if the ON time $t_E$ since the preceding switching off of the compressor C has expired. It is thus ensured that a sufficient time is available for the reduction of the head pressure in the compressor C from the preceding energizing cycle.

In the compressor re-start relay a further switching contact 26 can expediently be provided which in the end position of the switching member 1 at the second paramagnetic member 4 switches on a means 27 for the more rapid reduction of the head pressure of the compressor C. It can thus be achieved that the head pressure of the compressor C is reduced more rapidly during the OFF time $t_A$ for example by bridging a restriction.

In the compressor re-start relay according to FIG. 9, the full power of the compressor C is switched via the switch 25, switching relay has, however, the advantage that it is fail-safe, i.e. if the PTC resistor 5 fails and/or the coil of the magnet 24 is interrupted the energizing of the compressor C is possible in any event.

Figure 10:
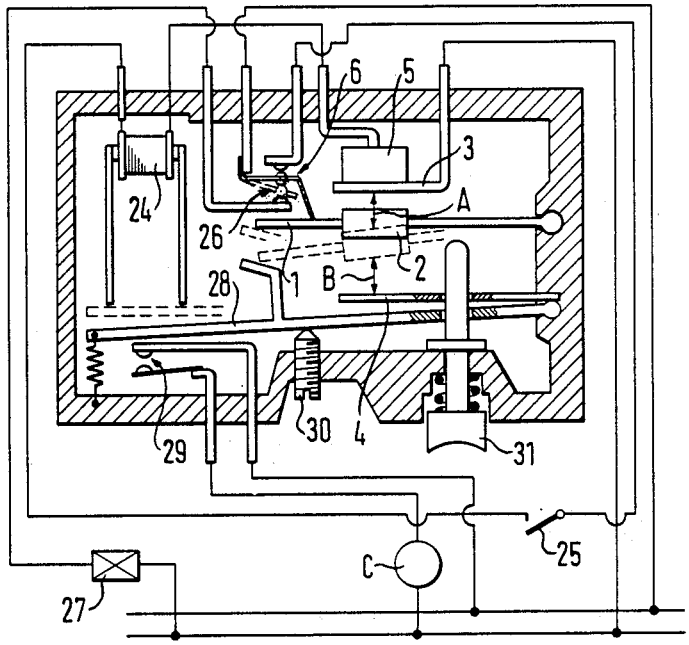

In FIG. 10 a further embodiment of a compressor restart relay is shown wherein the full power of the compressor is not switched directly via the switch 25. The switching contact 6 in the end position of the switching member 1 at the first paramagnetic member 3 closes the feed circuit of the PTC resistor 5 here, a spring-loaded lever 28 forms both a stop for the switching member 1 on the side of the second paramagnetic member 4 and also a further switching member for a power switching contact 29 closed in the end position of the first switching member 1 at the first paramagnetic member 3. Electrically in series connection to the feed circuit of the PTC resistor 5 the electric holding magnet 24 acting here on the lever 28 in its end position at the first paramagnetic member 3 is provided. The load, for example the compressor C, is energized here via the switching contact of the switch 25 initiating the switching on operation, but rather via the separate power switching contact 29.

In both compressor re-start relays the adjustment of the OFF time $t_A$ is essential. Accordingly an adjustment screw 30 engaging with the switching member 1 or lever 28 is provided to adjust the end position of the switching member 1 at the second paramagnetic member 4. Upon adjustment of this adjustment screw 30 the ON time $t_E$ remains unchanged, whereas the OFF time $t_A$ is varied, namley as described in connection with FIG. *2a*.

Finally, on each compressor re-start relay a spring-loaded push button 31 acting on the switching member 1 is provided for the manual movement of the switching member 1 into its end position at the first paramagnetic member 3. This push button 31 permits a manual energizing of the compressor C for testing purposes even with directly preceding operation of the compressor C.

What I claim:

1. Temperature compensated switching relay with thermally effected switching delay, comprising:

a switching member movable between two end positions and bearing a permanent magnet, said switching member actuating at least one switching contact, a first and a second paramagnetic member provided on opposite sides of said permanent magnet in the direction of movement thereof, a PTC resistor feedable by a source of current, mounted on said first paramagnetic member, the distance of said permanent magnet from said first paramagnetic member in an end position of said switching member at said second paramagnetic member being less than its distance from said paramagnetic member.

2. Switching relay according to claim 1, wherein the ratio of the distance of said permanent magnet from said paramagnetic members is adjustable.

3. Switching relay according to claim 1, wherein an adjustable stop means is provided for said switching member at its one end position and/or at its other end position.

4. Switching relay according to claim 3, wherein said at least one switching contact in the end position of said switching member at said first paramagnetic member closes the feed circuit of said PTC resistor and said stop means for said switching member in the end position at said second paramagnetic member is constructed as stop screw with rotating knob.

5. Switching relay according to claim 1, wherein said at least one switching contact in the end position of said switching member at said first paramagnetic member closes the feed circuit of said PTC resistor and an adjustment screw acting on said second paramagnetic member having a rotating knob for adjustment of the distance between said first and said second paramagnetic members is provided.

6. Switching relay according to claim 1, wherein a locking bolt is provided which is shifted by said switching member upon movement into the end position at said second paramagnetic member said locking bolt associated with a door and operative when shifted by said switching member to lock said door.

7. Switching relay according to claim 6, wherein said at least one switching contact in the end position of said switching member at said second paramagnetic member closes a load circuit.

8. Switching relay according to claim 6, wherein a calibration screw acting on said second paramagnetic member is provided to adjust the distance between said first and said second paramagnetic members.

9. Switching relay according to claim 1, wherein said at least one switching contact in the end position of said switching member at said first paramagnetic member closes the feed circuit of said PTC resistor and a click-stop device with a release button is provided for releasably holding said switching member in the end position at said second paramagnetic member.

10. Switching relay according to claim 9, wherein an adjustment screw acting on said first paramagnetic member and/or an adjustment screw acting on said second paramagnetic member is provided to adjust the distance between said first and said second paramagnetic members.

11. Switching relay according to claim 9, wherein an adjustable stop means is provided for said switching member in the end position at said first paramagnetic member.

12. Switching relay according to claim 1, wherein said at least one switching contact in the end position of said switching member at said first paramagnetic member closes the feed circuit of said PTC resistor, and an electric holding magnet electrically in series connection to said feed circuit is provided acting on said switching member in the end position at said first paramagnetic member.

13. Switching relay according to claim 12, wherein a further switching contact in the end position of said switching member at said second paramagnetic member switches on a pressure reducing means for rapidly reducing head pressure in a compressor.

14. Switching relay according to claim 12, wherein an adjustment screw engaging with said switching member or lever is provided for adjusting the end position of said switching member at said second paramagnetic member.

15. Switching relay according to claim 12, wherein a spring-loaded push button acting on said switching member is provided for the manual movement of said switching member into its end position at said first paramagnetic member.

16. Switching relay according to claim 1, wherein said at least one switching contact in the end position of said switching member on said first paramagnetic member closes the feed circuit of said PTC resistor, a spring-loaded lever forms both a stop means for said switching member on the side of said second paramagnetic member and a further switching member for a power switching contact closed in the end position of said first switching member at said first paramagnetic member, and an electric holding magnet electrically in series connection to said feed circuit of said PTC resistor is provided acting on said lever in its end position at said first paramagnetic member.

17. Switching relay according to claim 16, wherein a further switching contact in the end position of said switching member at said second paramagnetic member switches on a pressure reducing means for the rapidly reducing head pressure in a compressor.

18. Switching relay according to claim 16, wherein an adjustment screw engaging with said switching member or lever is provided for adjusting the end position of said switching member at said second paramagnetic member.

19. Switching relay according to claim 16, wherein a spring-loaded push button acting on said switching member is provided for the manual movement of said switching member into its end position at said first paramagnetic member.

* * * * *